US006136150A

United States Patent [19]

Larsson

[11] Patent Number: 6,136,150

[45] Date of Patent: Oct. 24, 2000

[54] METHOD AND DEVICE ACHIEVEING A FLOW OF STOCK IN A FORMING TANK

[75] Inventor: Johan Peter Larsson, Norrkoping, Sweden

[73] Assignee: Celtec Development AB, Norrkoping, Sweden

[21] Appl. No.: 09/077,843

[22] PCT Filed: Dec. 6, 1996

[86] PCT No.: PCT/SE96/01619

§ 371 Date: Jun. 3, 1998

§ 102(e) Date: Jun. 3, 1998

[87] PCT Pub. No.: WO97/20986

PCT Pub. Date: Jun. 12, 1997

[30] Foreign Application Priority Data

Dec. 7, 1995 [SE] Sweden ..... 9504376

[51] Int. Cl.[7] ..... D21F 13/00

[52] U.S. Cl. ..... 162/218; 162/228; 162/380; 162/382; 162/387; 162/388; 162/389

[58] Field of Search ..... 162/218, 228, 162/267, 382, 387, 390, 388, 393, 407, 411, 315, 389, 391, 392, 394, 395, 380, 396, 408, 409

[56] References Cited

U.S. PATENT DOCUMENTS 1,211,229 1/1917 Pruyn et al. ..... 162/392

2,000,085 5/1935 Maginnis ..... 162/391

3,043,742 7/1962 Chaplin ..... 162/228

3,968,004 7/1976 Coffey et al. .

*Primary Examiner*—Peter Chin

*Attorney, Agent, or Firm*—Altera Law Group, LLC

[57] ABSTRACT

The invention relates to a method and an arrangement for producing a flow of stock in a moulding tank (1). In this, stock is pumped into the moulding tank (1) at the bottom (1*a*) and allowed to flow up over the brim (1*b*) thereof. During its rise in the moulding tank (1), the flow of stock pumped in is distributed by at least one grating placed essentially horizontally and provided with flow openings. An arrangement for performing the said method comprises a line (2*a*, 2*b*), connected to the moulding tank (1) and a machine vat for ready prepared stock, for delivering fresh stock to the moulding tank (1) by means of a pump (5) connecting with the line (2*a*, 2*b*). The line (2*b*) opens out in an area close to the bottom (1*a*) of the moulding tank (1) in such a way that an upwardly directed flow of stock is obtained. The pump (5) is adapted to deliver excess stock so that excess stock is allowed to flow over the brim (1*b*) of the moulding tank (1). At least one essentially horizontal grating (6, 7) provided with flow openings is arranged in the moulding tank (1).

6 Claims, 2 Drawing Sheets

METHOD AND DEVICE ACHIEVEING A FLOW OF STOCK IN A FORMING TANK

Figure 1:
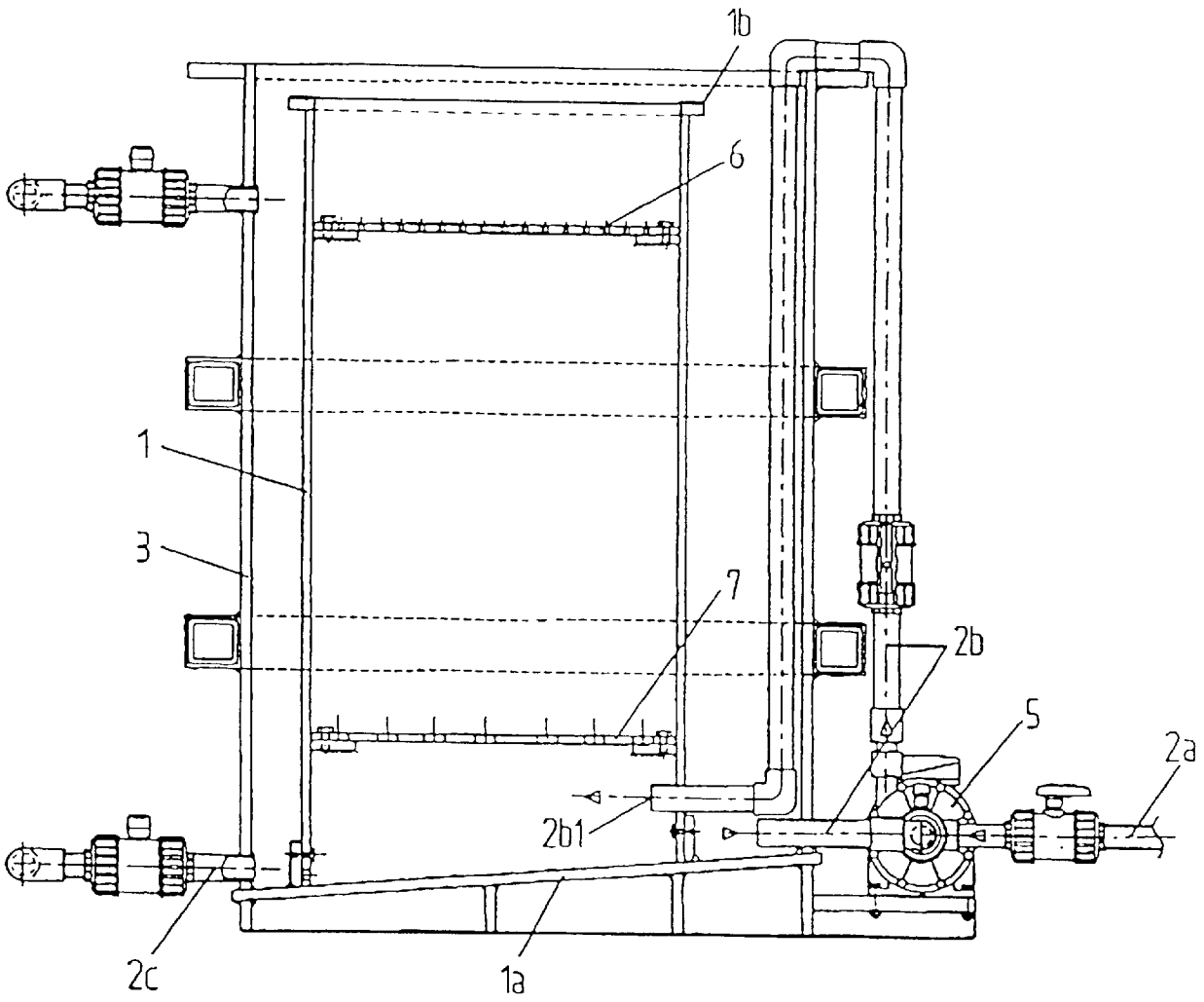

The present invention relates to a method of producing a flow of stock in a moulding tank.

The invention also relates to an arrangement in a moulding tank for producing a flow of stock therein, comprising a line, connected to the moulding tank and a machine vat for ready prepared stock, for delivering a fresh stock to the moulding tank by means of a pump which connects with the line.

Moulding tanks of this type are used to produce a fibre product, for example an egg carton or some other packaging product, from the fibres in the stock by means of a male tool with permeable walls and with the aid of a vacuum which sucks the water out of the stock so that the fibres remain on the outside of the tool. In order that the thickness of the fibre layer on the tool and hence the thickness of the product will be as uniform as possible it is essential that the fibre concentration of the flow of stock be as even as possible, at least in the upper areas of the tank.

In a known moulding tank the flow of stock is directed essentially horizontally. Two serious disadvantages arise as a consequence of this direction of flow; on the one hand most of the fibres in the fibre product become oriented in the direction of flow of the stock, which gives the product anisotropic characteristics, on the other the thickness of the fibre layer tends to become greatest where the flow of stock first encounters the tool. Anisotropy in the product means, for example, that it tends to become warped as the product dries out. The underlying reasons for this are well known to the person skilled in the art.

The object of the present invention is to achieve a method of the said type which eliminates the above-mentioned disadvantages. This is achieved according to the invention in that stock is pumped into the bottom of the moulding tank and allowed to flow up over its brim and that the flow of stock pumped in is distributed during its rise in the moulding tank by at least one grating, provided with flow openings and positioned essentially horizontally.

According to a special characteristic of the method according to the invention, a simplified handling of the overflow quantity of stock is achieved in that the overflowed stock is collected and together with fresh stock is pumped back into the moulding tank.

An arrangement of the type described in the preamble, by means of which the method according to the invention can be performed, is characterised in that the line opens in an area close to the bottom of the moulding tank in such a way that an upwardly directed flow of stock is obtained, that the pump is adapted to deliver excess stock so that excess stock can flow over the brim of the moulding tank and that at least one essentially horizontal grating, provided with flow openings, is arranged in the moulding tank.

According to a special characteristic of the invention the arrangement comprises a collecting tank for the excess stock and the pump is adapted to pump the excess stock from the collecting tank together with the fresh stock to the moulding tank, thereby achieving especially advantageous flow paths for the stock.

In order to obtain an optimum dispersal of fibres in the stock the arrangement, as will be apparent from another special characteristic of the invention, comprises two gratings positioned approximately symmetrically in relation to the half-height of the moulding tank, the lower grating having larger through-flow openings than the upper grating but the total through-flow area of both gratings being approximately equal.

Figure 2:
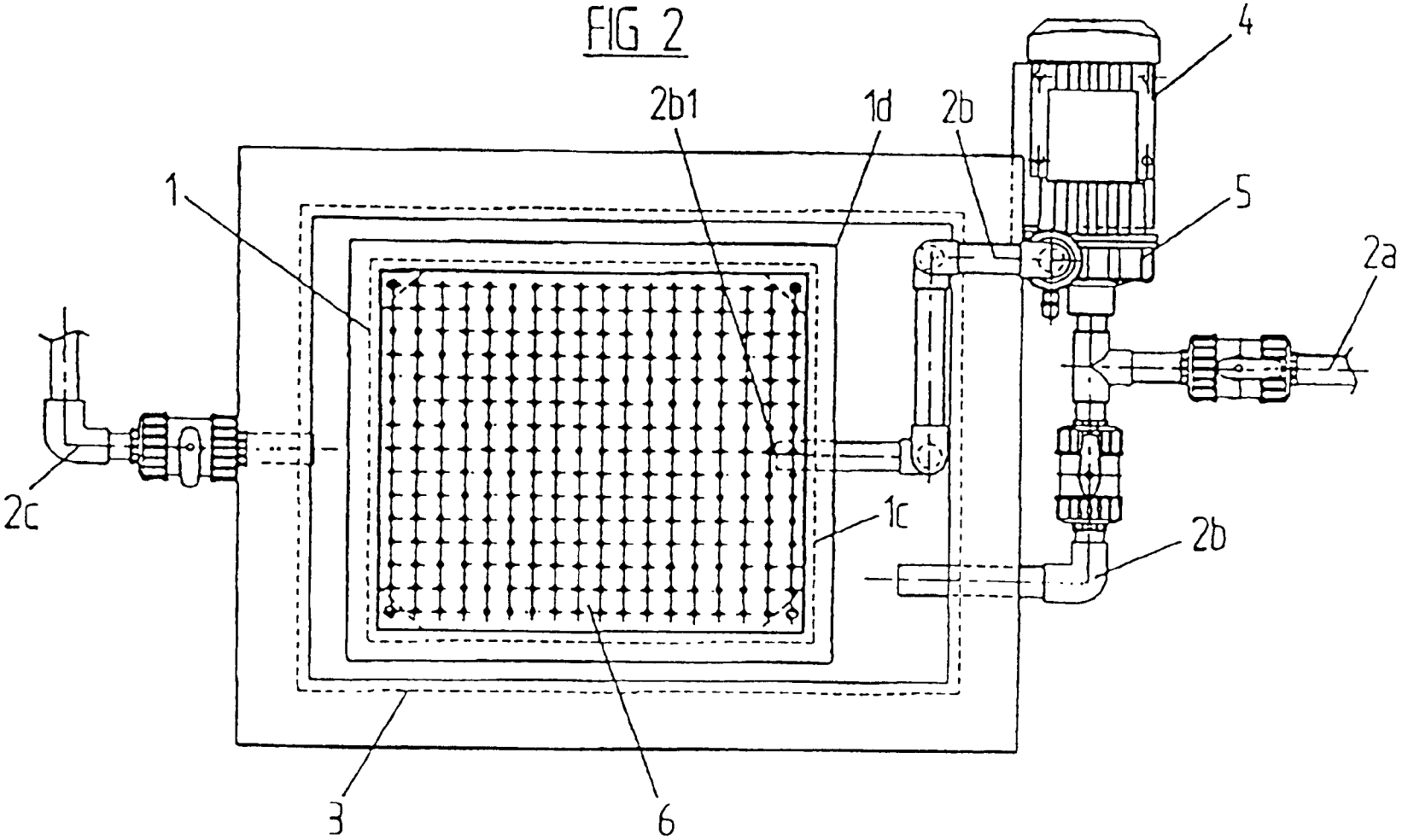

The invention will be further explained below with reference to the enclosed drawing in which FIG. 1 shows an embodiment of an arrangement according to the invention in plan view from the side and FIG. 2 the arrangement in a plan view from above.

In the drawing 1 denotes a moulding tank for stock intended to be used as described in the preamble. The tank 1 is connected by way of a line 2*a* to a machine vat, not shown in the drawing, for ready prepared stock. In the embodiment shown in the drawing the tank 1 is surrounded by a collecting tank 3. A pump 5, driven by an electric motor 4 and adapted to pump excess stock to the moulding tank, is connected into the line 2*a* so that excess stock can flow over the brim of the moulding tank and down into the collecting tank 3. A line 2*b* connects the collecting tank 3 to the moulding tank by way of the pump 5. The mouth 2*b*1 of the line 2*b* in the tank is situated in an area close to the bottom 1*a* of the tank, one side 1*c* of the said tank being specifically penetrated at a point situated approximately midway between the edges of this side. By means of this location of the mouth 2*b*1 an upwardly directed flow of stock is obtained in the moulding tank 1.

The bottom 1*a* of the moulding tank is inclined so that the tank can be drained by way of a line 2*c*. It is known that fibres tend to flocculate. In order to prevent the occurrence of such flocs two horizontal gratings 6, 7 are arranged in the moulding tank 1. The said gratings are preferably made of perforated plate, the lower grating 7 having a larger hole diameter than the upper grating 6, but the perforation being executed so that the total through-flow areas of the two gratings are essentially equal.

In operation the arrangement according to the invention functions as follows: Fresh stock is fed into the moulding tank 1 from the machine vat, not shown in the drawing, by way of the line 2*a*. Fresh stock, together with stock which has flowed over the brim 1*b*, is pumped by means of the pump 5 by way of line 2*b* to the moulding tank 1, specifically to the bottom 1*a* thereof. In this way an upwardly directed flow of stock is achieved which is homogenised by the gratings 6, 7.

The fact that the flow is directed upwards is important in achieving a fibre layer of even thickness on the male tool described in the preamble. That is to say the fibres in the upwardly directed flow are oriented in random directions, at least at the instant the fibres reach the male tool, as a result of which the anisotropy in the product referred to earlier is virtually zero.

It will be evident to the person skilled in the art that means of control are required for controlling valves which are not shown or described, so that a suitable flow is obtained with respect to the stock level sensed by means of level sensors. It is further obvious that the embodiment of the arrangement according to the invention can be modified in many ways within the framework of the invention.

What is claimed is:

1. A method of producing a flow of stock in a molding tank, comprising:

pumping stock into the molding tank at the bottom of the molding tank, the molding tank having a brim, so that a flow of stock flows upwards from the bottom of the tank to the top of the tank and over the brim of the tank; and distributing the flow of stock, as it flows upwards from the bottom of the molding tank, by at least one grating disposed across the tank essentially horizontally, between the bottom of the molding tank and the brim, the grating having flow openings to evenly distribute fibers contained in the stock at least at an upper part of the molding tank.

2. A method as recited in claim 1, further comprising collecting stock after overflowing the brim of the tank, and pumping the collected stock back into the tank together with fresh stock.

3. Apparatus in a molding tank in order to produce a flow of stock therein, comprising:

a molding tank having a brim;

a line, coupled to the molding tank for delivering fresh stock to the molding tank, the line opening into the molding tank close to a bottom of the molding tank to produce an upwardly directed flow of stock when stock flows through the line;

a pump, connecting with the line, to pump stock in the line into the molding tank, the pump being adapted to deliver excess stock so that excess stock flows over the brim of the molding tank; and at least one grating provided with flow openings and disposed essentially horizontally across the molding tank between the line opening into the molding tank and the brim.

4. Apparatus as recited in claim 3, further comprising a collecting tank disposed to receive the excess stock flowing over the brim of the molding tank, wherein the pump is adapted to pump the excess stock from the collecting tank together with fresh stock into the molding tank.

5. Apparatus as recited in claim 3, wherein the at least one essentially horizontal grating includes upper and lower gratings, placed approximately parallel and spaced approximately equidistant from a molding tank mid-height point, the lower grating having larger through-flow openings than the upper grating, total through-flow areas of the upper and lower gratings being approximately equal.

6. Apparatus as recited in claim 4, wherein the at least one essentially horizontal grating includes upper and lower gratings, placed approximately parallel and spaced approximately equidistant from a molding tank mid-height point, the lower grating having larger through-flow openings than the upper grating, total through-flow areas of the upper and lower gratings being approximately equal.

* * * * *